United States Patent [19]

Chenoweth et al.

[11] Patent Number: 4,889,764

[45] Date of Patent: Dec. 26, 1989

[54] NON-WOVEN FIBROUS PRODUCT

[75] Inventors: Vaughn C. Chenoweth, Coldwater; Roger C. Goodsell, Albion, both of Mich.

[73] Assignee: Guardian Industries Corp., Northville, Mich.

[21] Appl. No.: 343,579

[22] Filed: Apr. 27, 1989

Related U.S. Application Data

[63] Continuation-in-part of Ser. No. 322,642, Mar. 13, 1989, which is a continuation of Ser. No. 195,262, May 18, 1988, abandoned, which is a continuation-in-part of Ser. No. 53,406, May 22, 1987, Pat. No. 4,751,134.

[51] Int. Cl.[4] ..... B32B 5/16

[52] U.S. Cl. ..... 428/283; 428/242; 428/244; 428/284; 428/286; 428/288; 428/297; 428/373; 428/902; 428/403

[58] Field of Search ..... 428/242, 244, 283, 284, 428/286, 288, 297, 373, 902, 903

[56] References Cited

U.S. PATENT DOCUMENTS

| | | | |
|---|---|---|---|
| 2,483,405 | 10/1949 | Francis, Jr. | 154/54 |
| 2,689,199 | 9/1954 | Pesce | 154/46 |
| 2,695,855 | 11/1954 | Stephens | 154/54 |
| 4,568,581 | 2/1986 | Peoples, Jr. | 428/35 |
| 4,612,238 | 9/1986 | DellaVecchio et al. | 428/228 |
| 4,637,951 | 1/1987 | Gill et al. | 428/215 |
| 4,643,940 | 2/1987 | Shaw et al. | 428/308 |

*Primary Examiner*—James J. Bell

*Attorney, Agent, or Firm*—Willian Brinks Olds Hofer Gilson & Lione

[57] ABSTRACT

A non-woven matrix of glass and synthetic fibers provides a rigid but resilient product having good strength and insulating characteristics. The matrix consists of glass fibers, first, solid or hollow homogeneous synthetic fibers such as polyester, nylon or Kevlar and second, bi-component synthetic fibers which have been intimately combined with a thermosetting resin into a homogeneous mixture. This mixture is dispersed to form a blanket. The bi-component synthetic fibers include an outer low melting temperature sheath and a higher melting temperature core. Initial curing of the fiber matrix entails melting and subsequent fiber bonding by the material of the sheath. Final curing entails activation of the thermosetting resin. The product may be utilized in a planar configuration or be further formed into complexly curved and shaped configurations. The product may also include a skin or film on one or both faces thereof. A conductive material in either particulate or fibrous form may be added to improve surface finish and, if desired and depending upon the choice of conductive material, darken the appearance of the product.

20 Claims, 2 Drawing Sheets

NON-WOVEN FIBROUS PRODUCT

CROSS REFERENCE TO CO-PENDING APPLICATION

This application is a continuation-in-part application of Ser. No. 322,642, filed Mar. 13, 1989, which is a continuation of Ser. No. 195,262, filed May 18, 1988, now abandoned. Said latter application is a continuation-in-part application of Ser. No. 053,406, filed May 22, 1987, now U.S. Pat. No. 4,751,134 granted June 14, 1988.

BACKGROUND OF THE INVENTION

The present invention relates to an improved non-woven fibrous product and more specifically to a non-woven product of mineral and man-made fibers which exhibits improved strength and toughness. The man-made, i.e., synthetic, fibers are of two kinds: standard homogeneous fibers and fibers having a high melting point core and low melting point sheath. The blanket may be formed into sheets, panels and complexly curved and configured products.

Non-woven fibrous products including sheets and panels as well as other thin-wall products such as insulation and complexly curved and shaped structures formed from such planar products are known in the art In U.S. Pat. No. 2,483,405, two distinct types of fibers therein designated non-adhesive and potentially adhesive fibers are utilized to form a non-woven product The potentially adhesive fibers typically consist of a thermoplastic material which are mixed with non-adhesive fibers to form a blanket, cord or other product such as a hat. The final product is formed by activating the potentially adhesive fibers through the application of heat, pressure or chemical solvents Such activation binds the fibers together and forms a final product having substantially increased strength over the unactivated product.

U.S. Pat. No. 2,689,199 relates to non-woven porous, flexible fabrics prepared from masses of curled, entangled filaments. The filaments may be various materials such as thermoplastic polymers and refractory fibers of glass, asbestos or steel. A fabric blanket consisting of curly, relatively short filaments is compressed and heat is applied to at least one side to coalesce the fibers into an imperforate film. Thus, a final product having an imperforate film on one or both faces may be provided or this product may be utilized to form multiple laminates. For example, an adhesive may be applied to the film surface of two layers of the product and a third layer of refractory fibers disposed between the film surfaces to form a laminate.

In U.S. Pat. No. 2,695,855, a felted fibrous structure which incorporates a rubber-like elastic material and a thermoplastic or thermosetting resin material is disclosed. The mat or felt structure includes carrier fibers of long knit staple cotton, rayon, nylon or glass fibers, filler fibers of cotton linter or nappers, natural or synthetic rubber and an appropriate resin. The resulting structure of fibers intimately combined with the elastic material and resinous binder is used as a thermal or acoustical insulating material and for similar purposes.

U.S. Pat. No. 4,568,581 teaches a method of manufacturing and an article comprising a non-woven blend of relatively high melting point fibers and relatively low melting point fibers. At one surface of the article the low melting point fibers have a fibrous form and at the opposite surface they exhibit a non-fibrous, fused form.

U.S. Pat. No. 4,612,238 discloses and claims a composite laminated sheet consisting of a first layer of blended and extruded thermoplastic polymers, a particulate filler and short glass fibers, a similar, second layer of a synthetic thermoplastic polymer, particulate filler and short glass fibers and a reinforcing layer of a synthetic thermoplastic polymer, a long glass fiber mat and particulate filler. The first and second layers include an embossed surface having a plurality of projections which grip and retain the reinforcing layer to form a laminate.

One of the inherent difficulties of the non-woven plural component mat products discussed above relates to the character and strength of the fiber-to-fiber bonds. When a thermoplastic resin is utilized, a significant portion of the resin particles reside in locations within the fiber matrix where their melting and adhering provide little or no benefit. This occurs wherever a resin particle, rather than bridging and securing two adjacent fibers merely melts on or around a single fiber. Since there is no way to ensure the emplacement of resin particles only at fiber junctions, an excess of resin must be utilized in the blanket in order to assure that sufficient bonds do develop to produce the requisite strength in the final product. This increases the cost of the final product. Conversely, not all fiber junctions receive sufficient resin to create a fiber-to-fiber bond. Accordingly, unless an excessive amount of thermosetting resin is added to the fiber blanket, it will not exhibit the strength and ruggedness theoretically possible because many junction bonds are absent.

The use of low and high melting point fibers as suggested in U.S. Pat. Nos. 2,983,405 or 4,568,581 does not entirely solve this difficulty. If the low melting point fiber is sufficiently melted to provide adhesion to another, higher melting point fiber, it may melt and completely lose its structure. Since low melting point thermoplastics are typically relatively flexible and resilient and are utilized in such products for these characteristics, the melting and agglomeration of the fiber into adherent junctions of the other fibers will result in a loss of resilience to the product.

It is apparent from the foregoing review of non-woven mats, blankets and felted structures that variations and improvements in such prior art products are not only possible but desirable.

SUMMARY OF THE INVENTION

The present invention relates to a non-woven blanket or mat consisting of a matrix of mineral fibers and man-made fibers. The mineral fibers are preferably glass fibers. The man-made, i.e., synthetic, fibers are of two types. The first type may be conventional, homogeneous solid or hollow fibers of polyester, rayon, acrylic, vinyl, nylon or similar synthetic materials. The second type of fibers are bi-component core and sheath fibers of materials, typically polyesters, having distinct melting points. A thermosetting resin bonds the fiber matrix together. A conductive material such as copper or aluminum powder or a conductive/coloring agent such as carbon black may also be added and assists static dissipation during manufacture resulting in a product with improved surface finish. Alternatively, the conductive material may be in the form of fibers.

The product consists essentially of fiberized glass fibers of three to ten microns in diameter. Such fibers, in an optimum blend, comprise 66% by weight of the final product. The synthetic, homogeneous fibers may be selected from a wide variety of materials such as polyesters, nylons, rayons, acrylics, vinyls and similar materials. Larger diameter and/or longer synthetic fibers typically provide more loft to the product whereas smaller diameter and/or shorter fibers produce a denser product. The optimum proportion of synthetic fibers is approximately 12% by weight. The synthetic, bi-component fibers, consisting of a core of high melting point polyester surrounded by a sheath of low melting point polyester comprise about 5% by weight of the final product.

A thermosetting resin is dispersed uniformly throughout the matrix of the mineral and synthetic fibers and is utilized to bond the fibers together into the final product configuration. The optimum proportion of the thermosetting resin is approximately 17% by weight.

If desired, a foraminous or imperforate film or skin may be applied to one or both surfaces of the blanket during its manufacture to enhance the surface finish of the product. Optionally, a conductive coloring agent such as carbon black or carbon fibers may be included in the product. On a total weight basis, the conductive material preferably constitutes about 1% or less by weight of the final product.

The density of the product may be adjusted by adjusting the thickness of the blanket which is initially formed and the degree to which this blanket is compressed during subsequent forming processes. Product densities in the range of from 1 to 50 pounds per cubic foot are possible.

It is therefore an object of the present invention to provide a non-woven matrix of glass and homogeneous and bi-component synthetic fibers having a thermosetting resin dispersed therethrough.

It is a still further object of the present invention to provide a non-woven matrix of glass fibers and homogeneous and bi-component core and sheath synthetic fibers having a thermosetting resin dispersed therethrough wherein the sheath of the bi-component fiber may be activated initially to provide sufficient strength to the matrix to permit handling and further processing of layers of distinct rigidity.

It is a still further object of the present invention to provide a non-woven matrix of glass and homogeneous and bi-component synthetic fibers having a conductive material and thermosetting resin dispersed therethrough and a skin or film on one or both surfaces thereof.

It is a still further object of the present invention to provide a non-woven matrix of glass fibers, homogeneous and bi-component synthetic fibers and thermosetting resin which has its strength and rigidity adjusted by the degree of activation of the thermosetting resin.

Further objects and advantages of the present invention will become apparent by reference to the following description of the preferred and alternate embodiments and appended drawings.

DESCRIPTION OF THE PREFERRED EMBODIMENT

Figure 1:
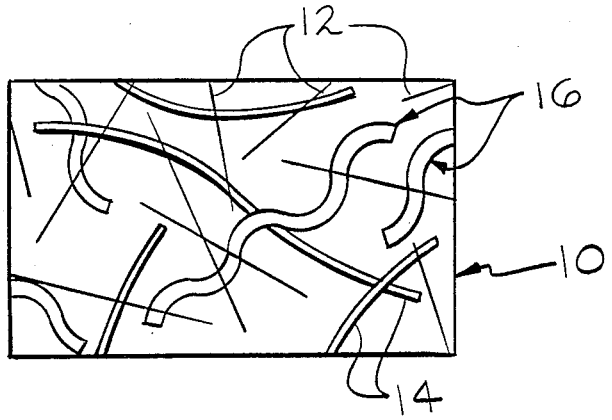
FIG. 1 is an enlarged, diagrammatic view of a non-woven fiber matrix according to the present invention.

Referring now to FIG. 1, an enlarged portion of a non-woven fibrous blanket which comprises a matrix of mineral and man-made fibers according to the present invention is illustrated and generally designated by the reference numeral 10. The non-woven fibrous blanket 10 includes a plurality of first, mineral fibers 12, second, homogeneous man-made, i.e., synthetic, fibers 14 and third, bi-component man-made, i.e., synthetic, fibers 16 homogeneously blended together to form a generally interlinked matrix.

The first, mineral fibers 12 are preferably glass fibers. If the fibers 12 are glass fibers, they are preferably substantially conventional virgin, rotary spun, fiberized glass fibers having a diameter in the range of from 3 to 10 microns. The first fibers 12 are utilized in a dry, i.e., non-resinated, condition. The length of the individual fibers 12 may vary widely over a range of from approximately one-half inch or less to approximately 3 inches and depends upon the shredding and processing the fibers 12 undergo which is in turn dependent upon the desired characteristics of the final product as will be more fully described subsequently. Other first, mineral fibers 12 having similar physical properties, i.e. size, tensile strength, melting point, etc., may also be utilized.

Figure 2A:
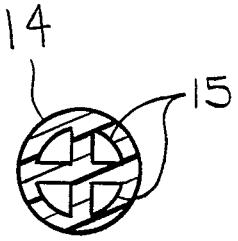
FIG. 2A is an enlarged, cross-sectional view of a hollow, homogeneous fiber utilized in a matrix according to the present invention.

As illustrated in FIGS. 1 and 2A, the second, homogeneous fibers 14 are synthetic, and may be selected from a broad range of appropriate materials. For example, polyesters, particularly Dacron polyester, nylons, Kevlar or Nomex may be utilized. Dacron is a trademark of the E. I. duPont Co. for its brand of polyester fibers and Kevlar and Nomex are trademarks of the E. I. duPont Co. for its brands of aramid fibers. As used in connection with the second fibers 14, the term "homogeneous" means of uniform composition and is intended to distinguish the second fibers 14 from the third, bi-component fibers 16 described below. The second, homogeneous synthetic fibers 14 preferably define individual fiber lengths of from approximately one quarter inch to four inches. The loft/density of the blanket 10 may be adjusted by appropriate selection of the diameter and- /or length of the synthetic, second fibers 14. Larger and/or longer fibers in the range of from 5 to 15 denier (approximately 25 to 40 microns) and one to four inches in length provide more loft to the blanket 10 and final product whereas smaller and/or shorter fibers in the range of from 1 to 5 denier (approximately 10 to 25 microns) and one quarter to one inch in length provide a final product having less loft and greater density. The second, homogeneous fibers 14 may likewise be either straight or crimped; straight fibers providing a final product having less loft and greater density and crimped fibers providing the opposite characteristics. The second, homogeneous fibers 14 may also be hollow and define one or a plurality of axial passageways 15. The fibers having the passageways 15 exhibit lower lineal weight and higher rigidity than solid fibers resulting in improved bulk retention.

Figure 2B:
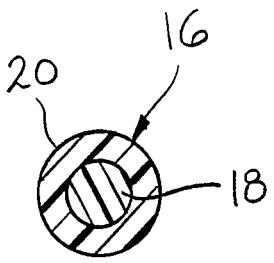
FIG. 2B is an enlarged, cross-sectional view of a bi-component fiber utilized in a matrix according to the present invention.

Referring now to the FIGS. 1 and 2B, the third, bi-component synthetic fibers 16 include a core 18 of a regular melt homopolymer polyester. The polyester core 18 exhibits a melting/bonding temperature of, for example, 485° F. (252° C.) and constitutes approximately 60 percent of the fiber 16 on a cross sectional and weight basis. The core 18 is fully surrounded by an annulus or sheath 20 of a low melt temperature copolymer polyester. The sheath 20 exhibits a melting/bonding temperature of, for example, 285° F. (138° C.) or, in any event, a temperature significantly lower, that is, at least about 100 degrees lower than the melting/bonding temperature of the core 18. The sheath 20 comprises approximately 40 percent of the cross section and thus weight of the bi-component fibers 16. A suitable product for use as the bi-component fibers 16 are Dacron polyester core and sheath fibers manufactured and sold by E.I. du Pont Co. Dacron, as noted, is a trademark of the E. I. duPont Co.

The bi-component fibers 16 have diameters in the range of from 1 to 10 denier (approximately 10 to 35 microns) and are preferably about 4 denier (approximately 20 microns). Length of the bi-component fibers 16 may range from less than about 1 inch to 3 inches and longer.

It should be understood that the melting/bonding temperatures recited directly above will be inherent features of the particular homopolymer and copolymer chosen. Accordingly, they may vary greatly from the temperatures given. What is important is that there be a significant difference between the melting point of the core 18 and the melting temperature of the sheath 20 and furthermore that the melting temperature of the sheath 20 be the lower of the two values. So configured, the sheath 20 will melt/bond at a lower temperature than the core 18, the features and benefits thereof within the context of the present invention being more fully described subsequently.

The first, mineral fibers 12, the second, homogeneous fibers 14 and the third, bi-component fibers 16 are shredded and blended sufficiently to produce a highly homogeneous mixture of the three fibers. The mat or blanket 10 is then formed and the product appears as illustrated in FIG. 1. Typically, the blanket 10 will have a uniform, initial thickness of between about 1 and 3 inches although a thinner or thicker blanket 10 may be produced if desired.

Figure 3:
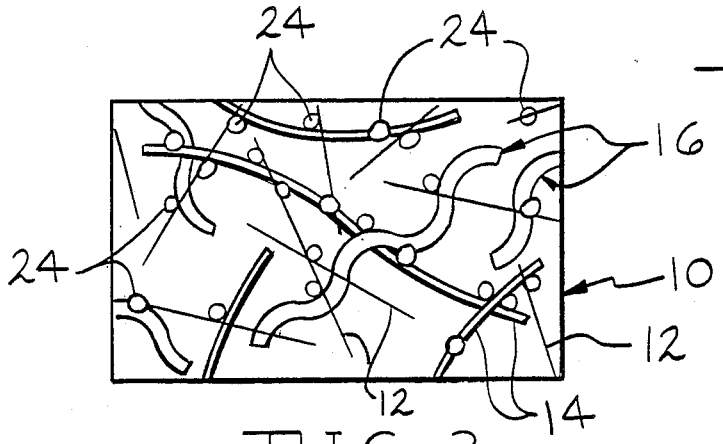
FIG. 3 is an enlarged, diagrammatic view of the fibers of a non-woven fiber matrix according to the present invention to which thermosetting resin particles have been added.

Referring now to FIG. 3, the blanket 10 also includes particles of a thermosetting resin 24 dispersed uniformly throughout the matrix comprising the first, mineral fibers 12, the second, homogeneous fibers 14, and the third, bi-component fibers 16. The thermosetting resin 4 may be one of a broad range of general purpose, engineering or specialty thermosetting resins such as phenolics, aminos, epoxies and polyesters. The thermosetting resin 24 functions as a second or final stage heat activatable adhesive to bond the fibers 12, 14, and 16 together at their points of contact, thereby providing structural integrity, and rigidity as well as a desired degree of resiliency and flexibility as will be more fully described below. The quantity of thermosetting resin 24 in the blanket 10 directly affects the maximum obtainable rigidity.

The choice of thermosetting resin 24 also affects density and loft. For example, shorter flowing thermosetting resins such as epoxy modified phenolic resins which, upon the application of heat, quickly liquify, generally rapidly bond the fibers 12, 14 and 16 together throughout the thickness of the blanket 10. Conversely, longer flowing, unmodified phenolic resins liquify more slowly and facilitate differential curing of the resin through the thickness of the blanket 10 as will be described more fully below.

Figure 4:
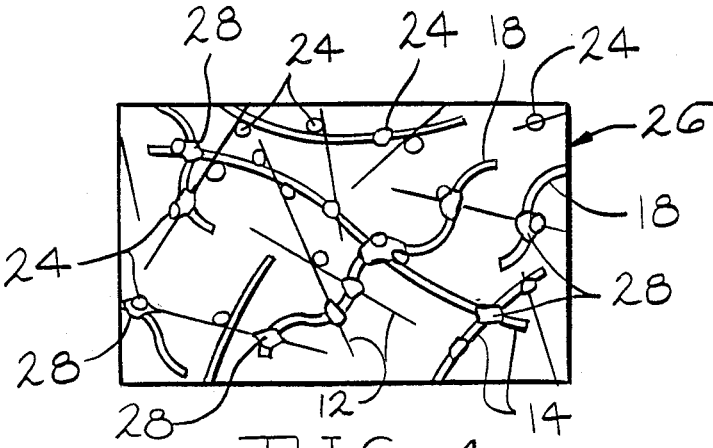
FIG. 4 is an enlarged, diagrammatic view of a non-woven fiber matrix according to the present invention wherein the matrix has been subjected to a temperature sufficiently high to melt only the sheath of the bi-component fiber but not to activate the thermosetting resin.

Referring now to FIG. 4, the first or B-stage curing of the blanket 10 which produces an intermediate product 26 is illustrated. As illustrated in FIG. 4, the blanket 10 has undergone heating to a temperature in the range of from about 260° F. (126° C.) to about 300° F. (150° C.). This initial processing or pre-curing melts the low melting temperature sheath 20 of the third, synthetic bi-component fiber 16. Instead of being distributed evenly about the core 18 as illustrated in FIGS. 2 and 3, the low melting/bonding temperature copolymer of the sheath 20 flows along the core 18 and agglomerates into junctions or bonds 28 wherever any of the first, mineral fibers 12 or second, homogeneous fibers 14 contact or are closely adjacent the third, bi-component synthetic fibers 16 illustrated in FIG. 3. It will thus be appreciated that the core 18 of the bi-component fibers 16 acts as a carrier or wick for the low melting temperature copolymer sheath 20 and, in so doing, facilitates excellent distribution of it to the other fibers 12 and 14, ensuring a maximum number of junctions or bonds 28 between such fibers. Furthermore, the junctions or bonds 28 are formed by the low melting temperature copolymer resulting in bonds and an intermediate product 26 which are more resilient and flexible than bonds and products formed by the bonding of higher temperature thermoplastics and particularly thermosetting resins.

Figure 5:
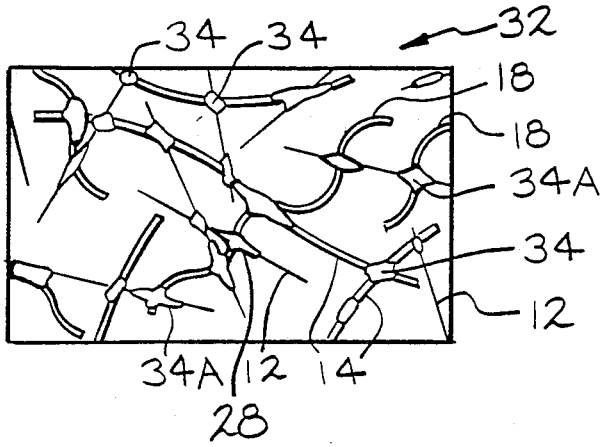
FIG. 5 is an enlarged, diagrammatic view of a non-woven fiber matrix according to the present invention which has been subjected to a temperature sufficiently high to activate the thermosetting resin.

Turning now to FIG. 5, a final product 32 according to the instant invention is illustrated. The product 32 has now undergone processing which includes forming in mating dies to conform the product 32 to a given, final desired shape and particularly subjecting the matrix of fibers 12, 14 and 16 and the thermosetting resin 24 to a temperature sufficient to activate, i.e., cure, the particular thermosetting resin 24 utilized. FIG. 5 illustrates the product 32 in its final form wherein the particles of thermosetting resin 24 illustrated in the preceding Figures have melted and agglomerated into junctions or bonds 34. Certain of the junctions or bonds such as the bonds identified by the number 34 generally in the upper portion of FIG. 5 are bonds formed solely of the thermosetting resin 24. The thermosetting resin 24 also reinforces the bonds 28 provided by the sheath 20 of low melting temperature copolymer, as illustrated by the bonds 34A to the right in FIG. 5. The bonds 34A are bonds of both the copolymer from the sheath 20 of the bi-component fiber 16 as well as a bond formed by particles of the thermosetting resin 24. In any event, it will be appreciated that the melting, activation and curing of the thermosetting resin 24 increases the strength and the rigidity of the intermediate product 26, thereby forming a final product 32 having the desired final strength, rigidity and other structural characteristics.

Figure 6:
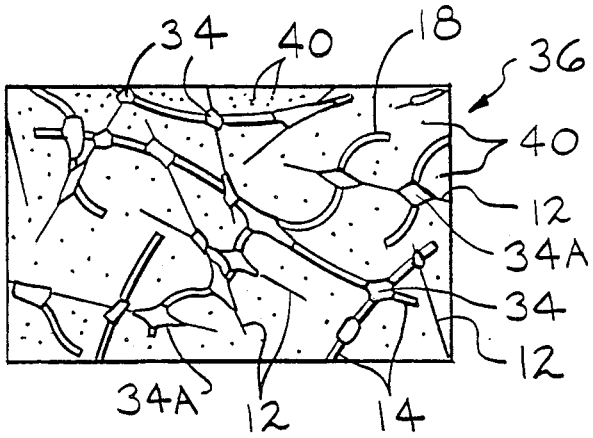
FIG. 6 is an enlarged, diagrammatic view of a first alternate embodiment of a non-woven fiber matrix product according to the present invention including conductive material dispersed therethrough.

Referring now to FIG. 6, a first alternate embodiment product 36 may include a conductive material 40 dispersed uniformly throughout the matrix comprising the first, mineral fibers 12, the second, homogeneous fibers 14 and the third, bi-component fibers 16. The conductive material 40 may be in either fibrous or particulate form. If the conductive material 40 is in particulate, i.e. powder, form the particles of conductive material 40 may be mixed with the fibers 12, 14 and 16, or mixed with the thermosetting resin 24 prior to application to the blanket 10 or the resin 24 and the particles of conductive material 40 may be applied to the blanket 10 separately. Alternatively, if in the form of fibers, the conductive material 40 may be blended with the fibers 12, 14 and 16 when they are blended and formed into the blanket 10.

The particles of conductive material 40 may be powdered aluminum or copper or carbon black. Other finely divided or powdered conductive materials, primarily metals, are also suitable. The carbon black may be like or similar to Vulcan P or Vulcan XC-72 fluffy carbon black manufactured by the Cabot Corporation. Vulcan is a trademark of the Cabot Corporation. Pelletized carbon black may also be utilized but must, of course, be pulverized before its application to the blanket 10 or mixing with the thermosetting resin 24 and application to the blanket 10.

The conductive material 40, if in particulate form and especially if it is carbon black, changes the appearance of the product 32, illustrated in FIG. 4, from its natural tan color through grey to silvery black and black depending upon the relative amount of carbon black added to the product 32. This color shading and particularly the choice of the degree of shading is advantageous in the automotive product market and in applications where the product 32 must be inobtrusive and/or blend with dark surroundings. Automobile hood liners and similar products are ideal applications for the product 32 which has been darkened by the inclusion of carbon black.

The following Table I delineates various ranges as well as an optimal mixture of the three fibers 12, 14 and 16 and the thermosetting resin 18. The Table sets forth weight percentages.

TABLE I

| | Functional | Preferred | Optimal |
|---|---|---|---|
| Glass Fibers (12) | 45–90 | 60–73 | 66 |
| Homo, Synthetic Fibers (14) | 3–30 | 8–18 | 12.5 |
| Bi-Comp. Synthetic Fibers (16) | 1–20 | 3–7 | 4.5 |
| Thermosetting Resin (24) | 5–40 | 14–20 | 17 |

In addition to the foregoing constituents, conductive material 40 may be added to a maximum weight percentage of 2% and preferably about 1% or less.

Figure 7:
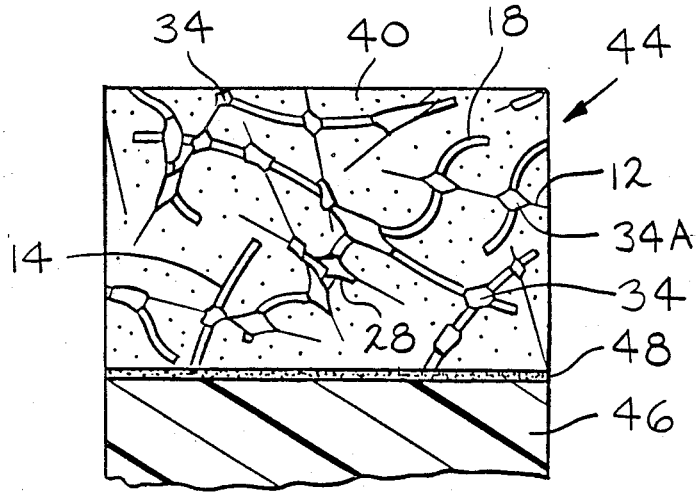
FIG. 7 is an enlarged, diagrammatic, fragmentary side elevational view of a second alternate embodiment of a non-woven fiber matrix product according to the present invention having a film disposed on one surface thereof.

A second alternate embodiment 44 of the product 32 according to the present invention is illustrated in FIG. 7. Here, the second alternate embodiment product 44, including the first, mineral fibers 12, the second, homogeneous synthetic fibers 14, the third, bi-component, synthetic fibers 18 and the thermosetting resin 24, further includes a thin skin or film 46. Preferably, the film 46 is adhered to one surface of the product 44 by a suitable adhesive layer 48. The adhesive layer 48 may be omitted, however, if sufficient bonding between the blanket 10 and the film 46 is achieved to satisfy the service requirements and other considerations of the product 32. The film 46 preferably has a thickness of from about 2 to 10 mils and may be any suitable material such as spunbonded polyester, spunbonded nylon as well as a scrim, fabric or mesh material of such substances. The skin or film 46 may be either foraminous or imperforate as desired. The prime characteristics of the film 46 are that it provides both a supporting substrate and a relatively smooth face for the product 44, which is particularly advantageous when it undergoes sequential activation of the bi-component fibers 16 and the thermosetting resin 24 as discussed above. It is preferable that the skin or film 46 not melt or become unstable when subjected to the activation temperatures associated with melting the sheath 20 of the bi-component fibers 16 of the thermosetting resin 24. It should be understood that the skin or film 46, though illustrated only on the face of the product 44, is suitable and appropriate for use on both faces, if desired.

The products 32, 36 and 44 according to the present invention provide greatly improved product strength over previous non-woven fibrous products and fabrication techniques. The term strength is used its broadest sense and includes tensile strength, toughness, flexibility and resistance to puncture. The improvement in these parameters is primarily the result of the incorporation of the synthetic, bi-component fibers 16 in the attendant improvement not only in the total number of bonds 28 achieved between adjacent fibers, that is, between the core 20 of the bi-component fibers 16 and the adjacent first, mineral fibers 12 and the second, synthetic fibers 14 but also the flexibility of these joints which are formed from the low melting temperature copolymer polyester of the sheath 20. In the final products 32, 36 and 44, wherein the thermosetting resin 24 has been cured, the relatively stiff and inflexible of the junctions or bonds 34 formed by the thermosetting resin 24 and the relatively resilient and flexible bonds 28 formed from the sheath 20 as well as bonds 34A formed from both the sheath 20 and thermosetting resin 24 provide a corresponding combination of qualities, that is, toughness combining both stiffness and shape retentivity as well as flexibility and a certain degree of conformability.

As to the temperatures stated above, it should be understood that they represent illustrative and relative temperatures and temperature ranges which relate primarily to the materials utilized. Generally speaking, however, it is the relative difference between the melting/bonding temperatures of the synthetic fibers 14 and 16 and that of the thermosetting resin 24 which are of most significance. That is, in order to achieve the appropriate initial flexible bonding (B-stage curing) provided by the sheath 20 of the bi-component fibers 16 followed by subsequent curing of the thermosetting resin 24 during the forming of the final configuration of a product, the melting temperature of the material of the sheath 20 defines the lowest melting temperature. Typically, such temperature will be in the range of from 150° (66° C.) to 350° F. (177° C.). The melting/curing temperature of the thermosetting resin 24 is at least 100° and preferably 150° F. higher than the melting temperature of the sheath 20, that is, from 300° F. (149° C.) to 550° F. (288° C.). The melting temperature of the core 18 of the synthetic, bi-component fiber 16 is desirably at least 50° and preferably significantly more than 50° above the melting temperature of the chosen thermosetting resin in order that the integrity of the core 18 of the synthetic, bi-component fiber 16 not be damaged by exposure to excessively high temperatures attendant the curing of the thermosetting resin 24.

The actual processing temperatures used to melt and cure the various fibers and resin will, of course, depend upon the composition of such materials which, in turn, depend upon the specific application and requirements of the various products 32, 36 and 44 to be fabricated. Generally speaking, products including materials having higher melting points will maintain their structural integrity at higher service and ambient temperatures whereas products fabricated of fibers and resin having lower melting temperatures will maintain flexibility at lower service and ambient temperatures. The foregoing is illustrative of one of the many parameters which may be considered in the selection of fibers and thermosetting resins. Accordingly, neither the temperature range presented nor the strength and application considerations discussed above should be considered to be limiting or defining of the present invention in any way.

The foregoing disclosure is the best mode devised by the inventors for practicing this invention. It is apparent, however, that products incorporating modifications and variations will be obvious to one skilled in the art of non-woven fibrous products. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

We claim:

1. A non-woven fibrous product comprising, in combination, a blended matrix of glass fibers and synthetic fibers, said synthetic fibers including homogeneous fibers selected from the group consisting of polyester, nylon, Nomex or Kevlar and bi-component fibers having a core of higher melting temperature polymer and a sheath of lower melting temperature polymer, and a thermosetting resin dispersed in said matrix.

2. The non-woven fibrous product of claim 1 further including conductive material of particles selected from the group consisting of carbon black, aluminum or copper.

3. The non-woven fibrous product of claim 1 further including conductive material of fibers selected from the group consisting of carbon, aluminum or copper.

4. The non-woven fibrous product of claim 1 wherein said glass fibers have a diameter of between approximately 3 and 10 microns and said synthetic fibers have a diameter of between approximately 10 and 40 microns.

5. The non-woven fibrous product of claim 1 wherein said glass fibers have a length of between approximately one half and three inches and said synthetic fibers have a length of between approximately one quarter and four inches.

6. The non-woven fibrous product of claim 1 wherein said glass fibers constitute between 60 and 73 weight percent of said product, said synthetic homogeneous fibers constitute between 8 and 18 weight percent of said product, said synthetic, bi-component fibers constitute between 3 and 7 weight percent of said product, and said thermosetting resin constitutes between 14 and 20 weight percent of said product.

7. The non-woven fibrous product of claim 1 wherein said glass fibers constitute about 66 weight percent of said product, said synthetic homogeneous fibers constitute about 12.5 weight percent of said product, said synthetic, bi-component fibers constitute between about 4.5 weight percent of said product, and said thermosetting resin constitutes about 17 weight percent of said product.

8. The non-woven fibrous product of claim 1 further including a plastic layer secured to at least one face of said matrix of fibers by an adhesive layer, said plastic layer having a thickness of from 2 to 10 mils.

9. The non-woven fibrous product of claim 1 wherein said higher melting temperature is at least 100° F. higher than said lower melting temperature.

10. A non-woven fibrous product comprising, in combination, a homogeneously blended matrix of glass fibers and synthetic fibers, said synthetic fibers including homogeneous fibers selected from the group consisting of polyester, nylon, Nomex or Kevlar and bi-component fibers having a core of higher melting temperature polymer and a sheath of lower melting temperature polymer, and a thermosetting resin disposed in said matrix.

11. The non-woven fibrous product of claim 10 further including conductive material dispersed within said blended matrix.

12. The non-woven fibrous product of claim 10 wherein said glass fibers have a diameter of between approximately 3 and 10 microns and said synthetic fibers have a diameter of between approximately 10 and 40 microns.

13. The non-woven fibrous product of claim 10 wherein said glass fibers have a length of between approximately one half and three inches and said synthetic fibers have a length of between approximately one quarter and four inches.

14. The non-woven fibrous product of claim 10 wherein said glass fibers constitute between 60 and 73 weight percent of said product, said synthetic homogeneous fibers constitute between 8 and 18 weight percent of said product, said synthetic, bi-component fibers constitute between 3 and 7 weight percent of said product, and said thermosetting resin constitutes between 14 and 20 weight percent of said product.

15. The non-woven fibrous product of claim 10 wherein said glass fibers constitute about 66 weight percent of said product, said synthetic homogeneous fibers constitute about 12.5 weight percent of said product, said synthetic, bi-component fibers constitute between about 4.5 weight percent of said product, and said thermosetting resin constitutes about 17 weight percent of said product.

16. The non-woven fibrous product of claim 1 wherein said sheath of said bi-component fibers has melted and formed bonds with adjacent said fibers and said thermosetting resin is in its uncured state.

17. The non-woven fibrous product of claim 10 further including a plastic layer secured to at least one face of said matrix of fibers by an adhesive layer, said plastic layer having a thickness of from 2 to 10 mils.

18. The non-woven fibrous product of claim 1 wherein said homogeneous synthetic fibers define at least one axial passageway.

19. The non-woven fibrous product of claim 10 wherein said higher melting temperature is at least 100° F. higher than said lower melting temperature.

20. A non-woven fibrous product comprising, in combination, a homogeneously blended matrix of glass fibers and synthetic fibers, said synthetic fibers including homogeneous fibers selected from the group consisting of polyester, nylon, Nomex or Kevlar fibers and bi-component polyester fibers having a core of higher melting temperature polyester and a sheath of lower melting temperature polyester, and a thermosetting resin disposed in said matrix.

* * * * *